US010179348B2

(12) United States Patent
Schirm et al.

(10) Patent No.: US 10,179,348 B2
(45) Date of Patent: Jan. 15, 2019

(54) MOBILE MODULAR SCREEN PLANT WITH HORIZONTAL AND VARIABLE OPERATING ANGLES

(71) Applicant: TEREX USA, LLC, Westport, CT (US)

(72) Inventors: Payton Schirm, Vinton, IA (US); Gregory Young, Cedar Rapids, IA (US)

(73) Assignee: TEREX USA, LLC, Westport, CT (US)

( * ) Notice: Subject to any disclaimer, the term of this patent is extended or adjusted under 35 U.S.C. 154(b) by 0 days.

(21) Appl. No.: 14/801,003

(22) Filed: Jul. 16, 2015

(65) Prior Publication Data

US 2015/0321224 A1 Nov. 12, 2015

Related U.S. Application Data

(63) Continuation of application No. 13/570,017, filed on Aug. 8, 2012, now Pat. No. 9,085,015.

(60) Provisional application No. 61/522,016, filed on Aug. 10, 2011.

(51) Int. Cl.

| | |
|---|---|
| ***B07B 1/28*** | (2006.01) |
| ***B07B 1/42*** | (2006.01) |
| ***B07B 1/00*** | (2006.01) |
| ***B07B 13/16*** | (2006.01) |
| ***B02C 23/10*** | (2006.01) |
| ***B07B 1/46*** | (2006.01) |

(52) U.S. Cl.

CPC ..... *B07B 1/005* (2013.01); *B02C 23/10* (2013.01); *B07B 1/28* (2013.01); *B07B 1/286* (2013.01); *B07B 1/46* (2013.01); *B07B 13/16* (2013.01); *B07B 2201/04* (2013.01); *Y10S 209/922* (2013.01); *Y10T 29/49826* (2015.01)

(58) Field of Classification Search

CPC .. B07B 1/005; B07B 1/28; B07B 1/46; B65G 21/14; B65G 41/002

See application file for complete search history.

(56) References Cited

U.S. PATENT DOCUMENTS

| | | | | |
|---|---|---|---|---|
| 5,335,784 | A | 8/1994 | Tyler | |
| 6,367,633 | B1 | 4/2002 | Douglas | |
| 6,698,594 | B2 | 3/2004 | Cohen et al. | |
| 6,877,610 | B2 | 4/2005 | Boast | |
| 7,980,393 | B2 | 7/2011 | Fennekotter et al. | |
| 2003/0173265 | A1 * | 9/2003 | Cohen | B07B 1/005 209/241 |
| 2009/0173671 | A1 | 7/2009 | O'Keeffe et al. | |
| 2010/0038291 | A1 | 2/2010 | Sauser | |

(Continued)

*Primary Examiner* — Luis A Gonzalez

(74) *Attorney, Agent, or Firm* — Simmons Perrine Moyer Bergman PLC

(57) ABSTRACT

A mobile variable angle vibrating screen with the ability to process aggregate material in a horizontal orientation and at incrementally higher angles of inclination where changes in angles of inclination can be affected without the need to dismantle the vibrating screen and without the use of hand tools. The variable angle screen being configured: to blend output at all of the various operating angles of inclination, be transportable with a detachable bolt on feeder module; have an overhead feed conveyor which operates at a substantially horizontal configuration and at various operating angles of inclination.

14 Claims, 20 Drawing Sheets

(56) References Cited

U.S. PATENT DOCUMENTS

| | | | | |
|---|---|---|---|---|
| 2010/0326065 | A1* | 12/2010 | Permi | B07B 1/005 60/327 |
| 2011/0000761 | A1* | 1/2011 | Werlinger | B65G 21/14 198/313 |
| 2012/0111774 | A1* | 5/2012 | Sauser | B07B 1/28 209/317 |

* cited by examiner

MOBILE MODULAR SCREEN PLANT WITH HORIZONTAL AND VARIABLE OPERATING ANGLES

CROSS REFERENCE TO RELATED APPLICATIONS

This application claims the benefit of the filing date of the provisional patent application having Ser. No. 61/522,016 filed Aug. 10, 2011. This application also relates to the patent applications listed below:

bearing Ser. No. 13/570,009, filed Aug. 8, 2012, U.S. Pat. No. 9,010,542, issued Apr. 21, 2015, and entitled SCREEN LIFT MECHANISM FOR VARIABLE SLOPE VIBRATING SCREENS by Payton Schirm and Greg Young; and bearing Ser. No. 13/570,001, filed Aug. 8, 2012, U.S. Pat. No. 8,820,536, issued Sep. 2, 2014, and entitled PLATFORM AND LADDER INTERFACE FOR VARIABLE SLOPE VIBRATING SCREENS by Payton Schirm; and bearing Ser. No. 13/569,521, filed Aug. 8, 2012, U.S. Pat. No. 8,967,387, issued Mar. 3, 2015, and entitled CONVEYOR JACKSHAFT FOR VARIABLE SLOPE VIBRATING SCREENS by Rex Carter; and bearing Ser. No. 13/569,726, filed Aug. 8, 2012, U.S. Pat. No. 8,701,894, issued Apr. 22, 2014, and entitled CONVEYOR SUPPORT MECHANISM FOR VARIABLE SLOPE VIBRATING SCREENS by Rex Carter; and bearing Ser. No. 13/569,878, filed Aug. 8, 2012, U.S. Pat. No. 8,899,423, issued Dec. 2, 2014 and entitled FINES SCALPING CHUTE FOR VARIABLE SLOPE VIBRATING SCREENS by Ken Irwin and Christopher Reed; and bearing Ser. No. 13/570,017, filed Aug. 8, 2012, U.S. Pat. No. 9,085,015, issued Jul. 21, 2015 and entitled MOBILE MODULAR SCREEN PLANT WITH HORIZONTAL AND VARIABLE OPERATING ANGLES by Payton Schirm and Gregory Young.

The contents of these applications are incorporated herein in their entirety by these references.

BACKGROUND OF THE INVENTION

This invention relates to vibrating screens and more particularly to mobile variably sloped vibrating screens.

The aggregate industry utilizes many styles of screen machines to sort aggregates by size. Most screen machines utilize vibration to agitate the mixture of aggregates to promote separation through various sized openings in the screening surfaces. Sorting is achieved by undersized particles passing through the openings in the screening surface and the oversized particles being retained above the screen surface. These machines usually have some type of vibrating mechanism to shake the unit and its screening surfaces. The vibrating mechanisms usually include an unbalanced weight mounted on one or several rotating shafts which, when rotated, force a cycling motion into the screen machine.

Sometimes a screen is designed to be oriented in various sloped positions. This is frequently found in portable equipment that requires a lower profile for travel, as well as multiple sloped positions, as needed, for various screening applications.

In the past, mobile variable sloped vibrating screens have often operated over a range of angles of inclination; for example, over a range of 10 to 20 degrees of inclination. However, these mobile variable sloped vibrating plants have not been able to operate as horizontal screen plants.

Consequently, there is a need for improvement in mobile sorting systems for variable slope vibrating screens which operate over a wide range of angles including down to 0 degrees of inclination (i.e. operate as a horizontal screen plant).

SUMMARY OF THE INVENTION

More specifically, an object of the invention is to provide an effective vibrating screen for use in a high variety of applications.

It is a feature of the present invention to include the ability to operate at angles of inclination from 0 and higher.

It is an advantage of the present invention to reduce the number of vibrating screen plants needed by an end user who needs flexibility in operation including horizontal (0 degrees) to variable sloped vibrating screens.

The present invention includes the above-described features and achieves the aforementioned objects.

Accordingly, the present invention comprises a horizontal vibrating screen with the ability to be inclined from 0 degrees upward and the ability to be transported on public roadways.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
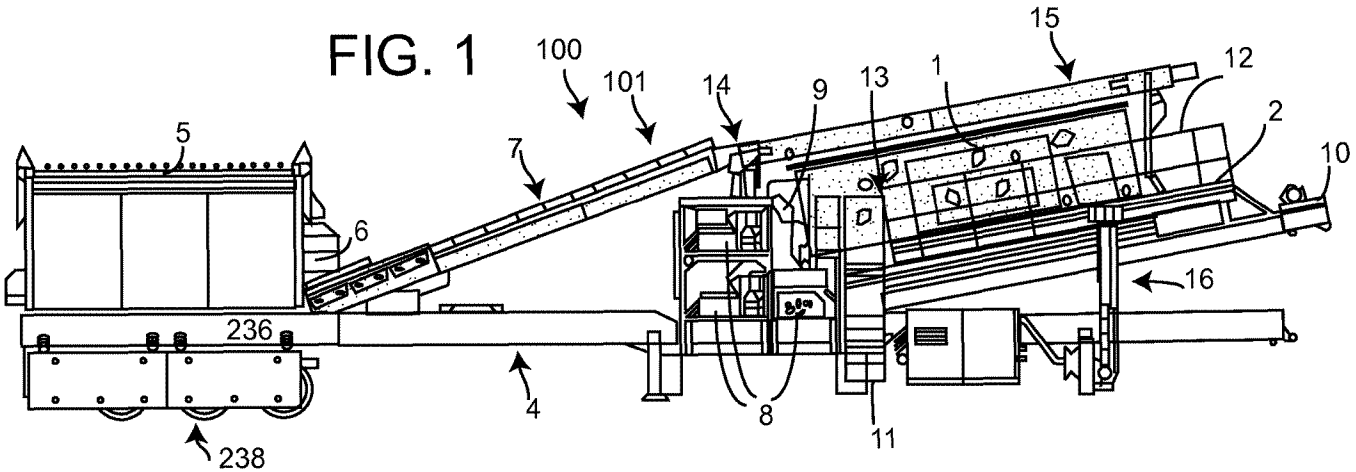
FIG. 1 is an elevation view of a material processing system of the present invention with a screen in an inclined operational configuration.

Now referring to the drawings wherein like numerals refer to like matter throughout, and more specifically referring to FIG. 1, there is shown an elevation view of a material processing system of the present invention, generally designated 100, with a screen 1 in an inclined operational configuration. System 100 includes a feed hopper 5 which may have grizzly bars or other sorting structure thereon to remove oversized objects. Screen 1 is shown disposed on feed hopper frame 236, which is shown supported by feed hopper wheels 238. The material which exits feed hopper 5 is fed up on belt feeder 6 and the bottom feed support section 7 portion of the overhead conveyor 101. A single continuous belt can be supported by bottom feed support section 7, independent intermediate conveyor support section 14 and overhead conveyor head support section 15. Throughout this description, conveyors are discussed as being troughing belt-type conveyors; however, it should be understood that this is an exemplary design, and other systems for conveying material, such as chain conveyors, rollers, augers and any type of system suitable for transporting material could be used. Screen base frame 2 is shown supporting screen 1 and also access walkway railing 12, so that both pivot together when the screen is sloped at an angle for operation. Screen 1, overhead conveyor 101, and feed hopper 5 are all supported by wheeled chassis main frame 4 which also supports, in a "frame fixed" or stationary configuration, cross conveyors 8, blend chute 9 and under screen conveyor 10. A ladder or vertical foot tread structure 11 is coupled to wheeled chassis 4 and not directly to screen base frame 2, which supports access walkway railing 12. It can be seen that steps to railing gap 13 have a variable width dimension when the screen 1 is sloped for operation, by manipulation of hydraulic adjustable support legs 16.

Figure 2:
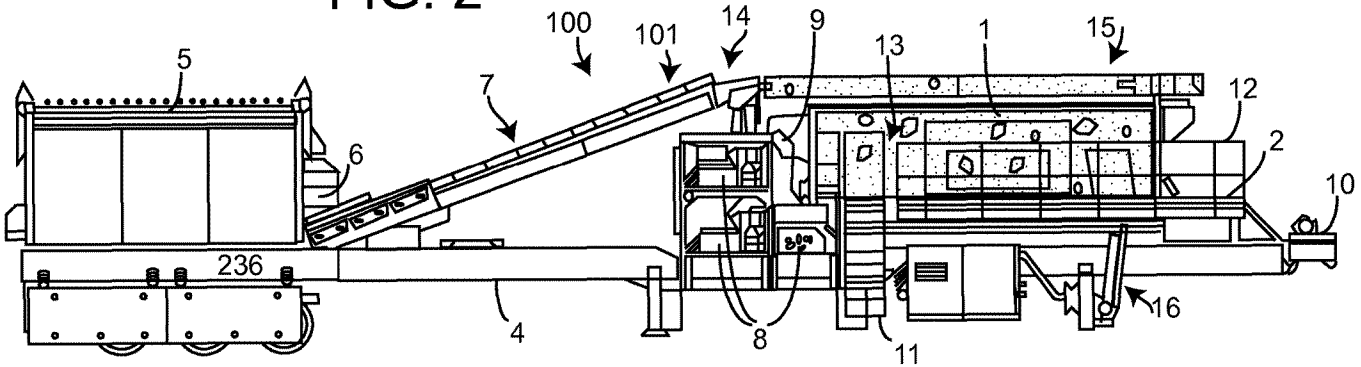
FIG. 2 is an elevation view of the system of FIG. 1 except that the screen is in a horizontal operational configuration.

Now referring to FIG. 2, there is shown the system 100 where the screen 1 is in a horizontal operational configuration. Note that the steps to railing gap 13 remain substantially the same width along vertical foot tread structure 11. Independent intermediate conveyor support section 14 is shown at the same angle as in FIG. 1, but the angle between independent intermediate conveyor support section 14 and overhead conveyor head support section 15 has changed.

Figure 3:
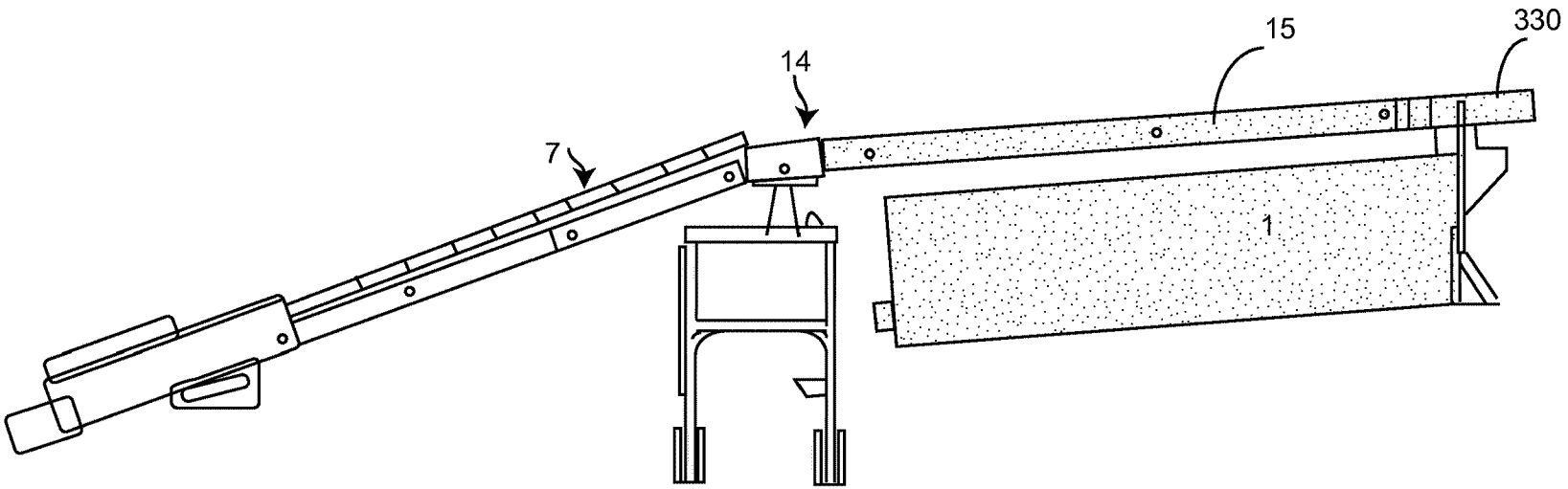
FIG. 3 is a close-up view of a portion of the system of FIGS. 1 and 2 except that the screen is in an intermediate inclined operational configuration.

A more complete understanding of the function and operation of independent intermediate conveyor support section 14 can be gleaned by now referring to FIG. 3, which shows the overhead conveyor head support section 15 oriented at a 5 degree incline (between that of FIGS. 1 and 2).

Figure 4:
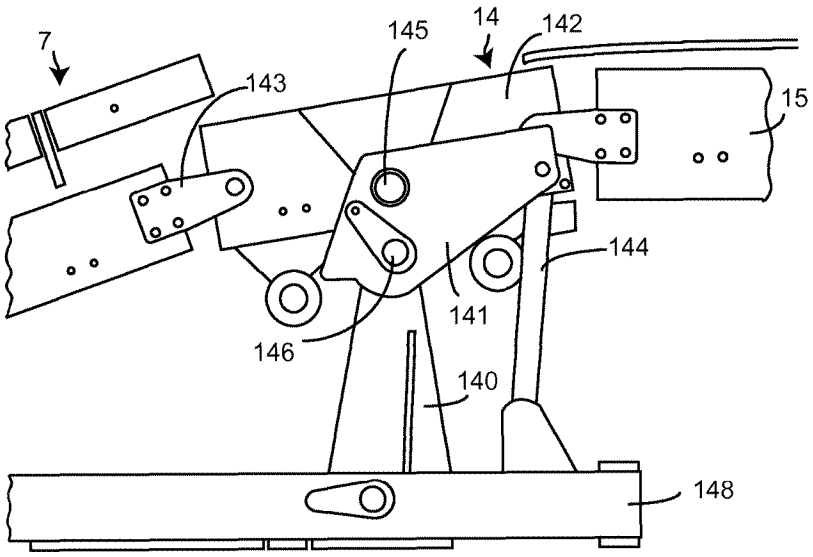
FIG. 4 is a close-up elevation view of an intermediate conveyor support portion of the system and configuration shown in FIG. 2.

Now referring to FIG. 4, there is shown a close-up elevation view of an intermediate conveyor support portion of the system and configuration shown in FIG. 2. The independent intermediate conveyor support section 14 remains at the same angle with respect to the wheeled chassis 4 in all positions of the screen base frame 2. Linkage is shown which maintains this angle, yet allows for relative movement between bottom feed support section 7 and overhead conveyor head support section 15. More specifically, there is shown an intermediate support main leg structure 140 which is pivotally coupled with chassis mounted support 148 and is coupled to intermediate support main linkage body 141 via main leg to main linkage body pivot pin 146. Intermediate support main roller support structure 142 is fixed to intermediate support main linkage body 141 via main roller support to main linkage body connection point 145 and pivotally coupled to bottom feed support section 7 via bottom feed to intermediate support pivotal link 143. Similarly, intermediate support main roller support structure 142 is coupled to overhead conveyor head support section 15. Pivoting main linkage body to chassis support 144 is pivotally coupled to both intermediate support main linkage body 141 and chassis mounted support 148.

Figure 5:
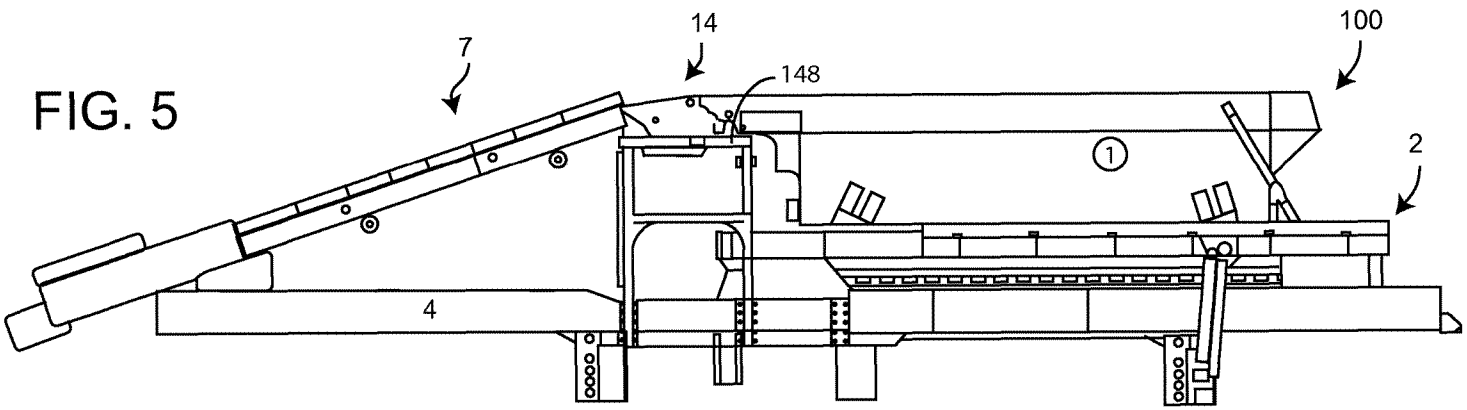
FIG. 5 is an elevation view of the system of FIG. 1 except that the screen is in a horizontal transport configuration.

Now referring to FIG. 5, there is shown an elevation view of the system of FIG. 1, except that the screen is in a horizontal transport configuration.

Figure 6:
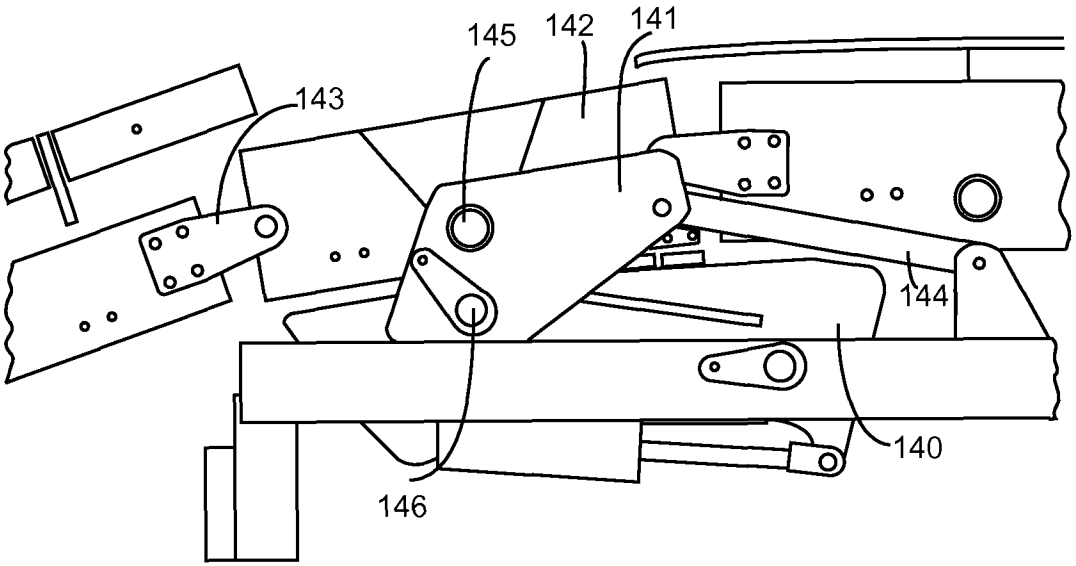
FIG. 6 is a close-up elevation view of an intermediate conveyor support portion of the system and configuration shown in FIG. 5.

Now referring to FIG. 6, there is shown a close-up elevation view of an intermediate conveyor support portion of the system and configuration shown in FIG. 5. In this configuration, the intermediate support main leg structure 140 is substantially horizontal, thereby meaning that the intermediate support main roller support structure 142 is at a lower elevation with respect to the chassis mounted support 148.

Figure 7:
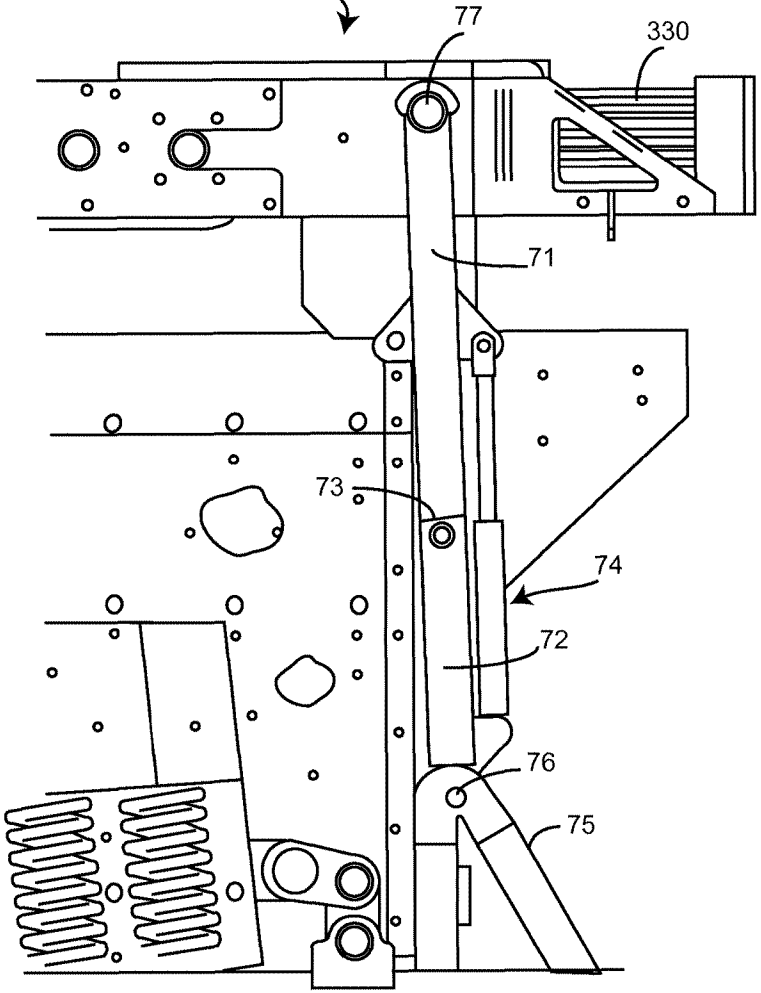
FIG. 7 is a close-up elevation view of a front conveyor support portion of the system and configuration shown in FIG. 2.

Now referring to FIG. 7, there is shown a close-up elevation view of a front conveyor support portion of the system and configuration shown in FIG. 2. Overhead conveyor head support section 15 is held in place by upper slide arm 71 and lower slide arm 72, which are coupled via sliding connection point 73. The length of upper slide arm 71 and lower slide arm 72 is controlled by hydraulic adjustable arm 74, which is coupled at a lower end to lower slide arm 72, which is coupled at pivot point 76 to screen base frame secured support structure 75. Hydraulic adjustable arm 74 is coupled at an upper end to upper slide arm 71, which is coupled to overhead conveyor head support section 15 at conveyor to slide arm pivot point 77. In this horizontal operational configuration, overhead conveyor head support section 15 is directly above, but separated from screen 1.

Figure 8:
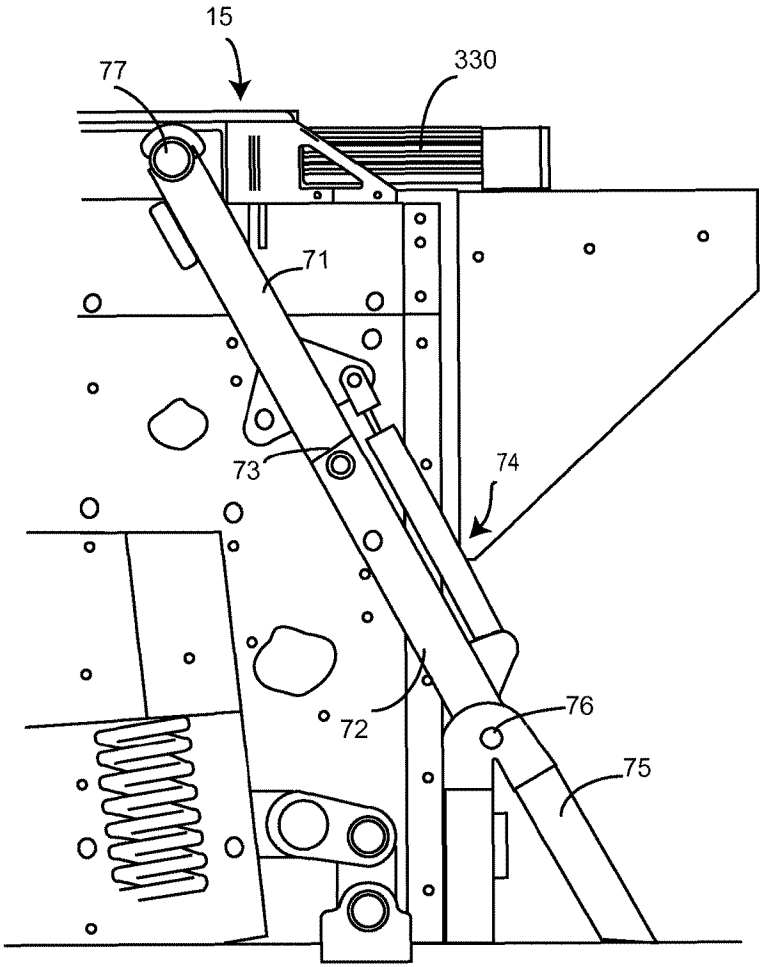
FIG. 8 is a close-up elevation view of a front conveyor support portion of the system and configuration shown in FIG. 5.

Now referring to FIG. 8, there is shown a close-up elevation view of a front conveyor support portion of the system and configuration shown in FIG. 5. Overhead conveyor head support section 15 is clearly shown disposed, at least in part, within a top portion of screen 1.

Figure 9:
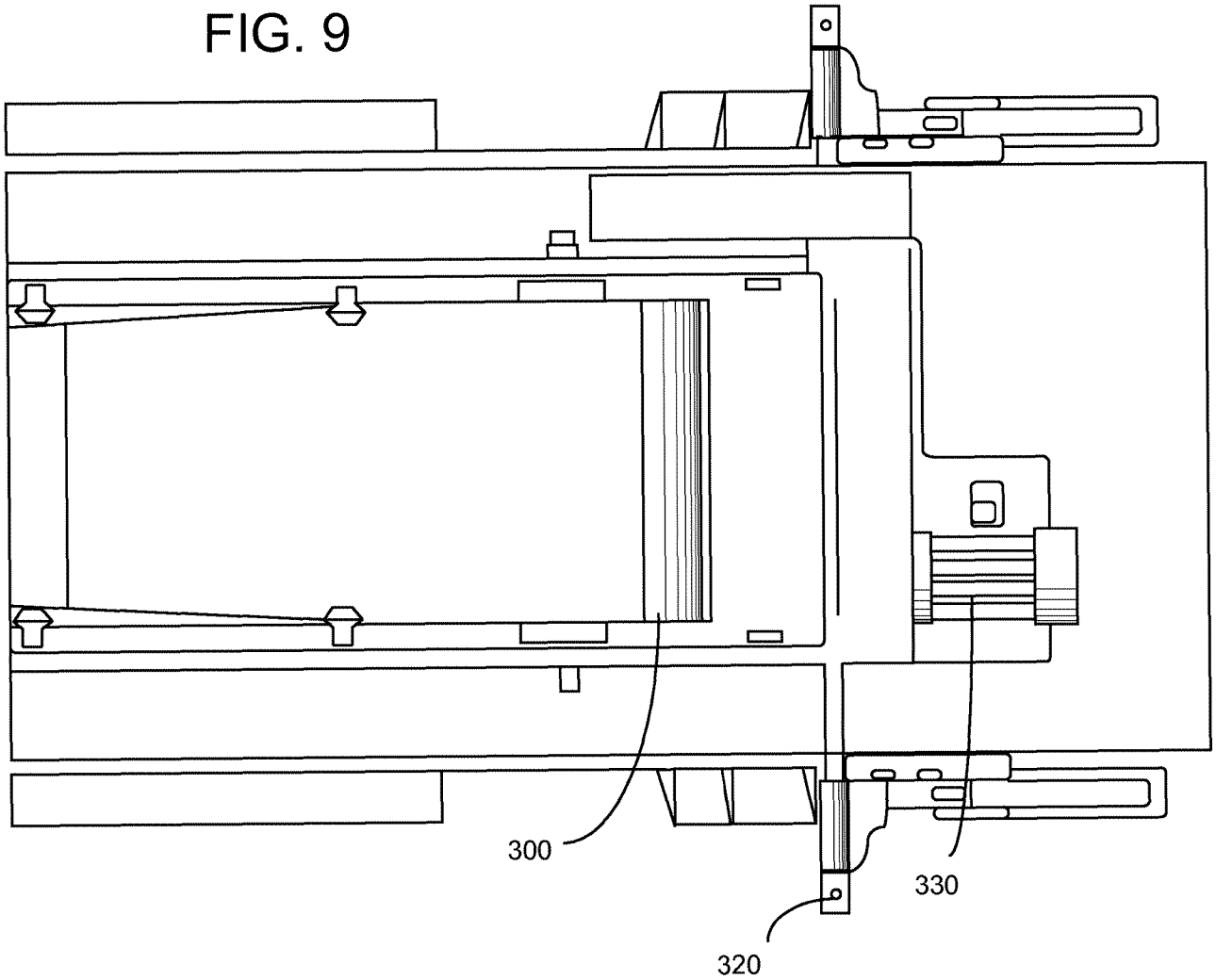
FIG. 9 is a plan view of the top of portions of the system and configuration of FIG. 5.

Now referring to FIG. 9, there is shown a plan view of the top of portions of the system and configuration of FIG. 5.

Figure 10:
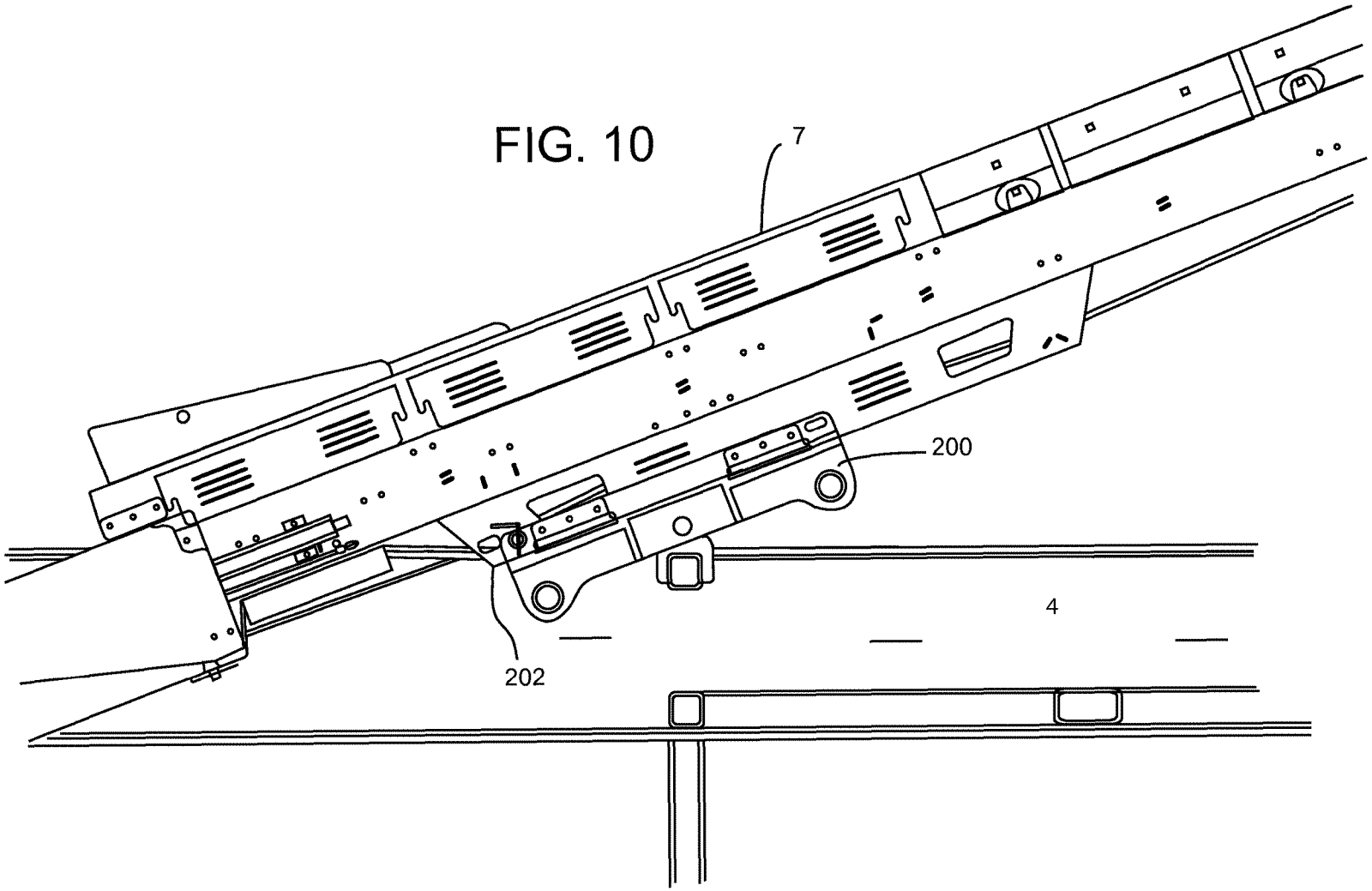
FIG. 10 is a close-up elevation view of a tail section slide/pivot support portion of the system and configuration shown in FIG. 2.

Now referring to FIG. 10, which shows a close-up elevation view of a tail section slide/pivot support portion of the system and configuration shown in FIG. 2, the bracket 200 is fixed to the wheeled chassis 4 while the fixed location 202 is fixed to the bottom feed support section 7 as it translates along its path.

Figure 11:
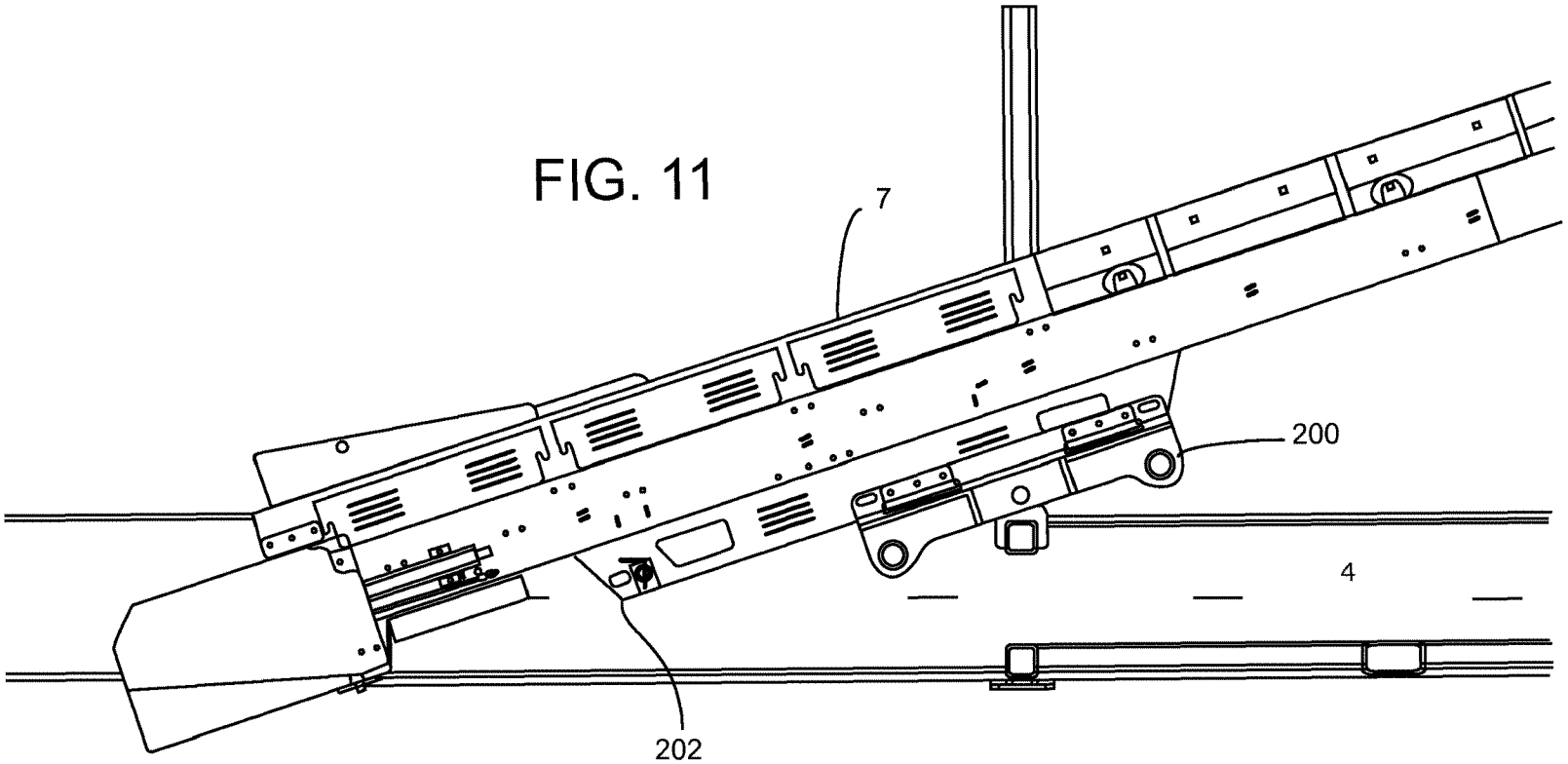
FIG. 11 is a close-up elevation view of a tail section slide/pivot support portion of the system and configuration shown in FIG. 5.

FIG. 11 is a close-up elevation view of a tail section slide/pivot support portion of the system and configuration shown in FIG. 5. Note that fixed location 202 is outside of the bracket 200.

Figure 12:
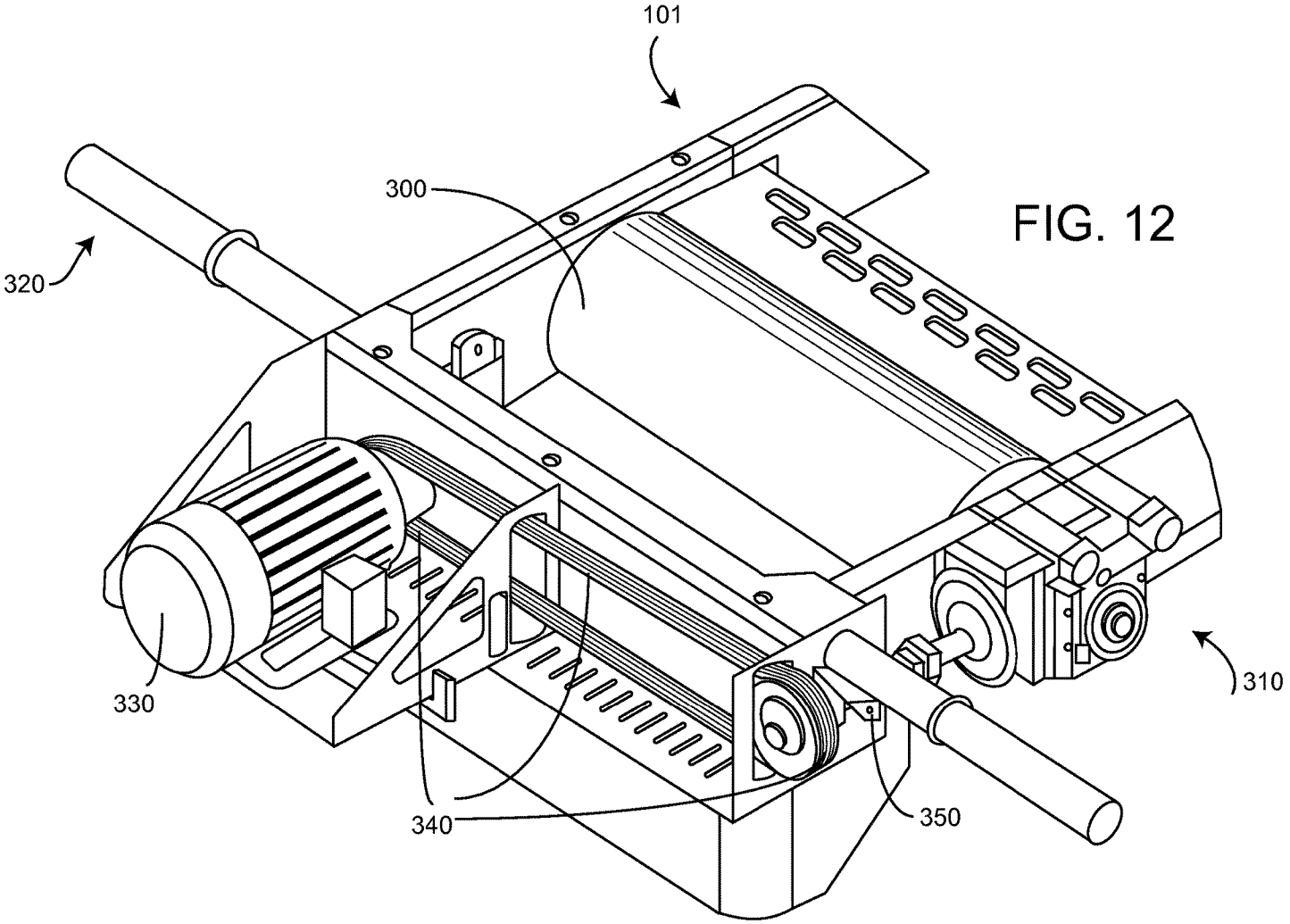
FIG. 12 is a close-up, partially dismantled view of the conveyor 15 of FIG. 9.

Now referring to FIG. 12, there is shown a close-up view of a portion of the overhead conveyor 101, which includes a head pulley 300 to cooperate with the conveyor belt (not shown) to move the conveyor belt and thereby transport material for processing. Head pulley 300 is driven through a speed reducer 310, which may be a 90-degree speed reducing gear assembly which is coupled to a jack shaft 350, which is coupled to v-belt drive 340 which is powered by motor 330. Speed reducer 310 is preferably an input shaft-type speed reducer which is flange or face mounted to the conveyor frame and is shorter in width (along the turning axis of head pulley 300) than the motor 330. The above system is supported at least in part by support structure 320, which may be disposed at side mount pivot point 77. Motor 330 may be a single speed motor, and speed of the rotation of the head pulley 300 can be changed by changing the size of sheaves on the motor 330 and jack shaft 350. The length of the jack shaft 350 may be varied; i.e., replaced with a longer jack shaft if high speed operation is expected and, therefore, the trajectory of material of the head pulley 300 would be flatter and further. The width of the overhead conveyor 101 is reduced because the width of the head pulley 300 and speed reducer 310 combined is less than what it would have been had the motor been mounted next to the speed reducer 310 in the present invention, so its central axis is parallel to the turning axis of the conveyor head pulley.

Figure 13:
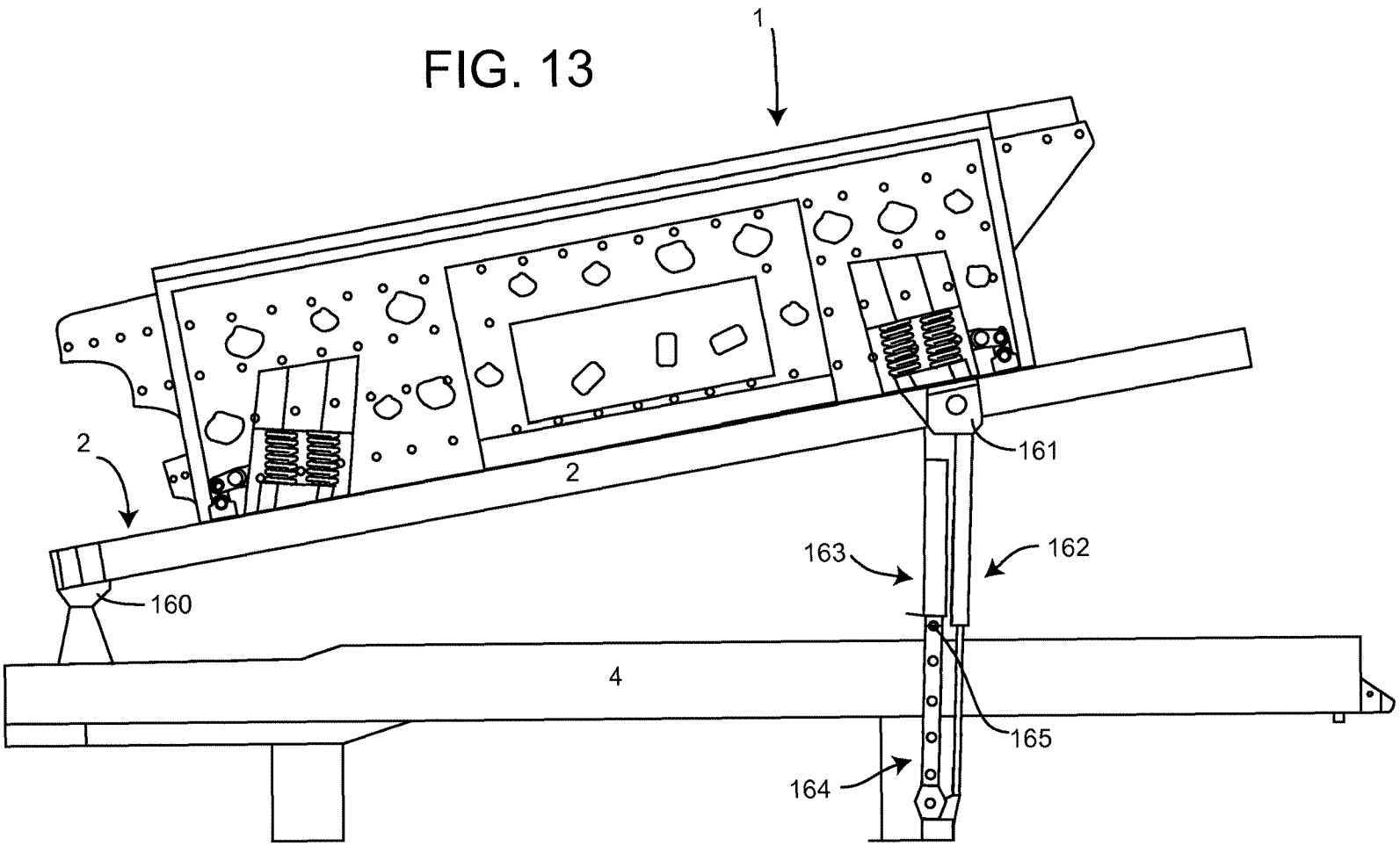
FIG. 13 is a close-up view of portions of the screen of FIG. 1.

Now referring to FIG. 13, there is shown screen 1 raised to an inclined operation position by hydraulic adjustable support legs 16, which comprise a cylinder 162 for providing lifting force and an outer adjustable support leg 163 and an inner adjustable support leg 164 which can be locked to a predetermined length by locking pin 165. The screen is coupled to hydraulic adjustable support legs 16 at lifting point 161 and is pivoted about base frame pivoting point 160. In operation, once the locking pin 165 is inserted, the cylinder 162 is commanded to pull down upon the locking pin 165, thereby removing any slack in the system that can result in unwanted vibration of the support structure. Alternatively, a threaded rod, ball screw or other tensioning device could be used to remove slack.

Figure 14:
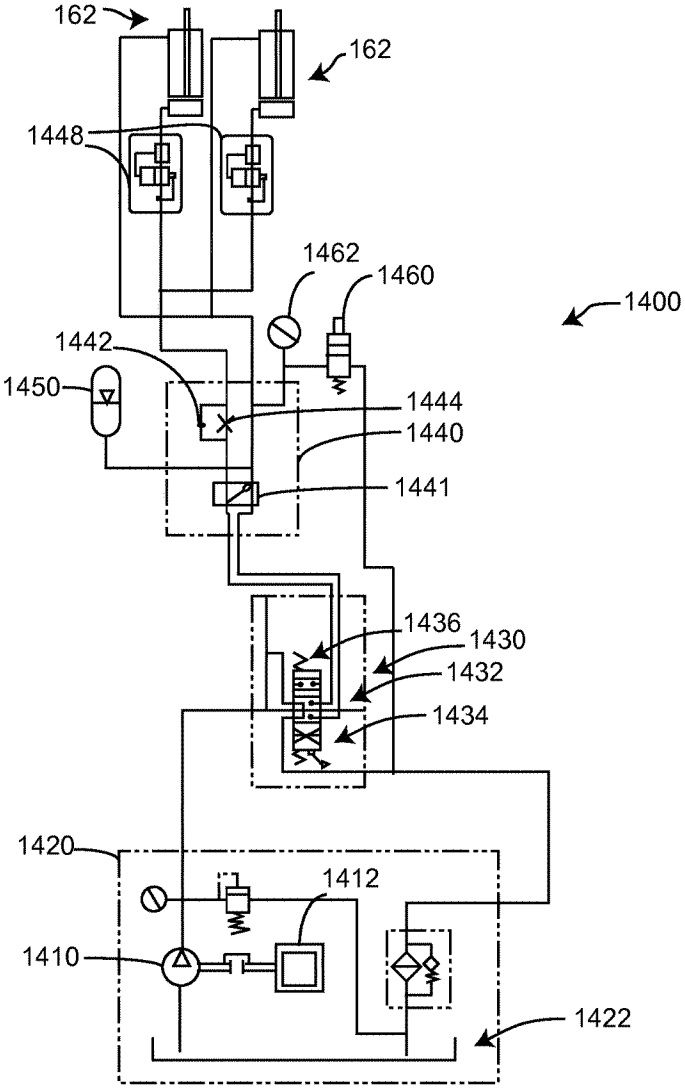
FIG. 14 is a schematic diagram of a hydraulic circuit of the present invention.

Now referring to FIG. 14, there is shown a hydraulic circuit, generally designated 1400. Generally, the system controls the operation of hydraulic adjustable support legs 16 via cylinder 162 by controlling hydraulic pressure thereto. The system performs two main functions: 1) lifting and lowering the screen 1 to angled orientations and 2) reducing the slack or slope in the mechanism holding or applying a biasing force to urge the screen in such positions. Hydraulic pressure power unit 1420 includes a hydraulic pump 1410 and a tank 1422 for providing high pressure hydraulic fluid to the cylinder 162. Hydraulic pump 1410 is coupled to system control valve 1430, which may be a 3 position valve with a system control valve return to tank normal position 1432, a system control valve return criss-cross flow position 1434 and a system control valve return up down position 1436, depending on the direction the valve is slid. Two lines (A and B) exit system control valve 1430 and go to cylinder 162. Note the cylinder 162 has a port for applying pressure to retract and another for extending. The lines into each of these ports are capable of providing fluid into and receiving fluid from the cylinder 162. Lines A and B enter manifold 1440 and encounter manifold pilot operated check valve 1441. Check valve 1441 allows free-flow of oil into cylinder 162, but flow control valve 1444 meters oil out of cylinder 162.

When the screen 1 is operating and the system 1400 is attempting to minimize slack in the support system, Pilot open check valve 1441 holds pressure in the retract side of cylinder 162. The accumulator 1450 stores the pressure in the system. Accumulator 1450 provides for this holding pressure to continue at a functional level longer and thereby reduce the frequency that the system will need to be re-pressurized to function optimally. A pressure gauge 1462 is provided so a worker can re-pressurize the accumulator when necessary. Alternately, this could be automated with a sensor and transducer loop etc. Flow fuses 1448 are included to minimize losses in the event of a sudden failure (e.g., a burst hose etc.). A dump valve 1460 is included for use during maintenance or other times when completely discharging the pressure in the system 1400 is desired.

Figure 15:
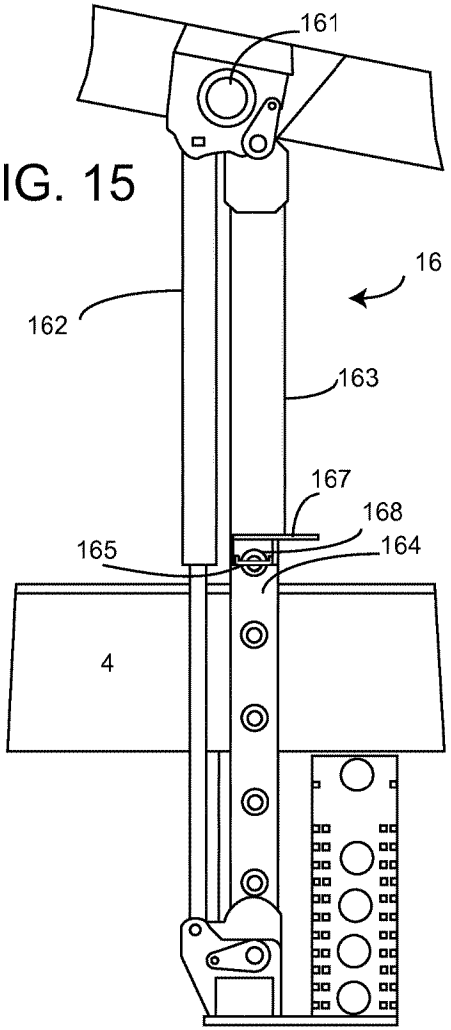
FIG. 15 is a close-up view of a portion of the screen of FIG. 13.

Now referring to FIG. 15, there is shown a close-up view of the hydraulic adjustable support legs 16 of the present invention, which includes cylinder 162 outer adjustable support leg 163, inner adjustable support leg 164, locking pin 165 and half circle void 168 in outer adjustable support leg 163 so as to receive locking pin 165. A pin storage bracket 167 is shown disposed adjacent to the half circle void 168 and is used to hold locking pin 165 when not inserted through the holes.

Figure 16:
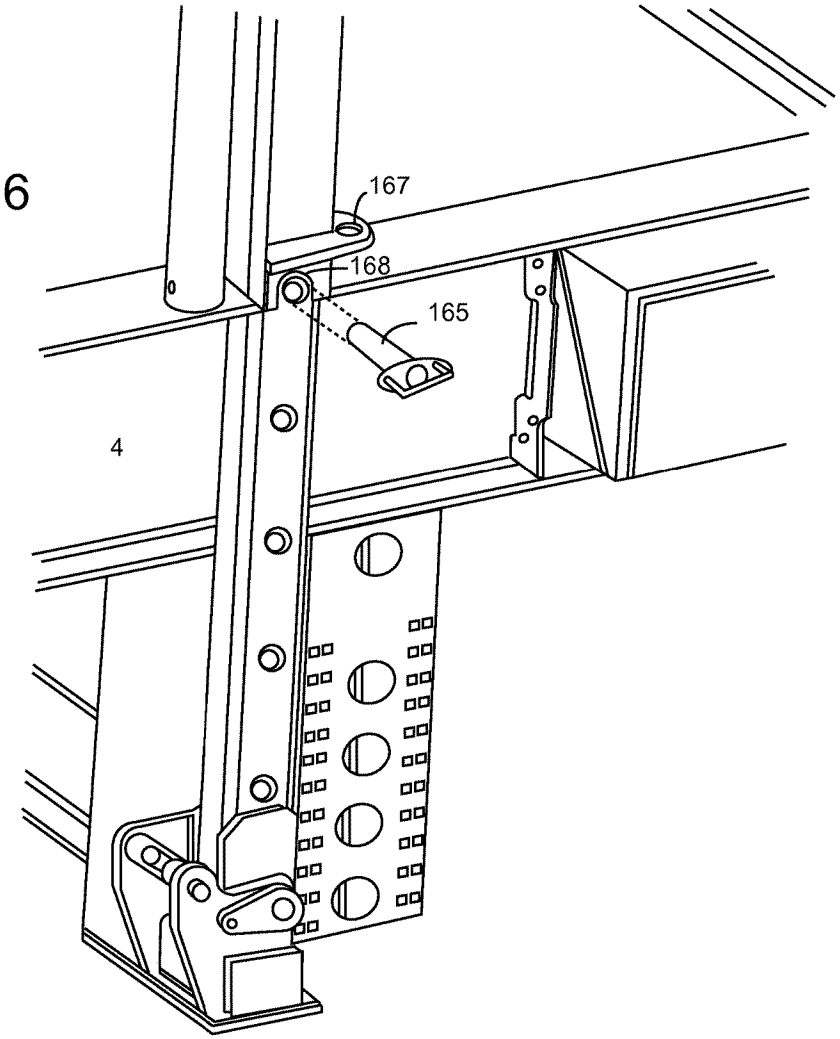
FIG. 16 is a very close-up partially exploded view of a portion of the assembly of FIG. 15.

Now referring to FIG. 16, there is shown a closer partially exploded view of outer adjustable support leg 163, inner adjustable support leg 164 and locking pin 165 combination of the present invention.

Figure 17:
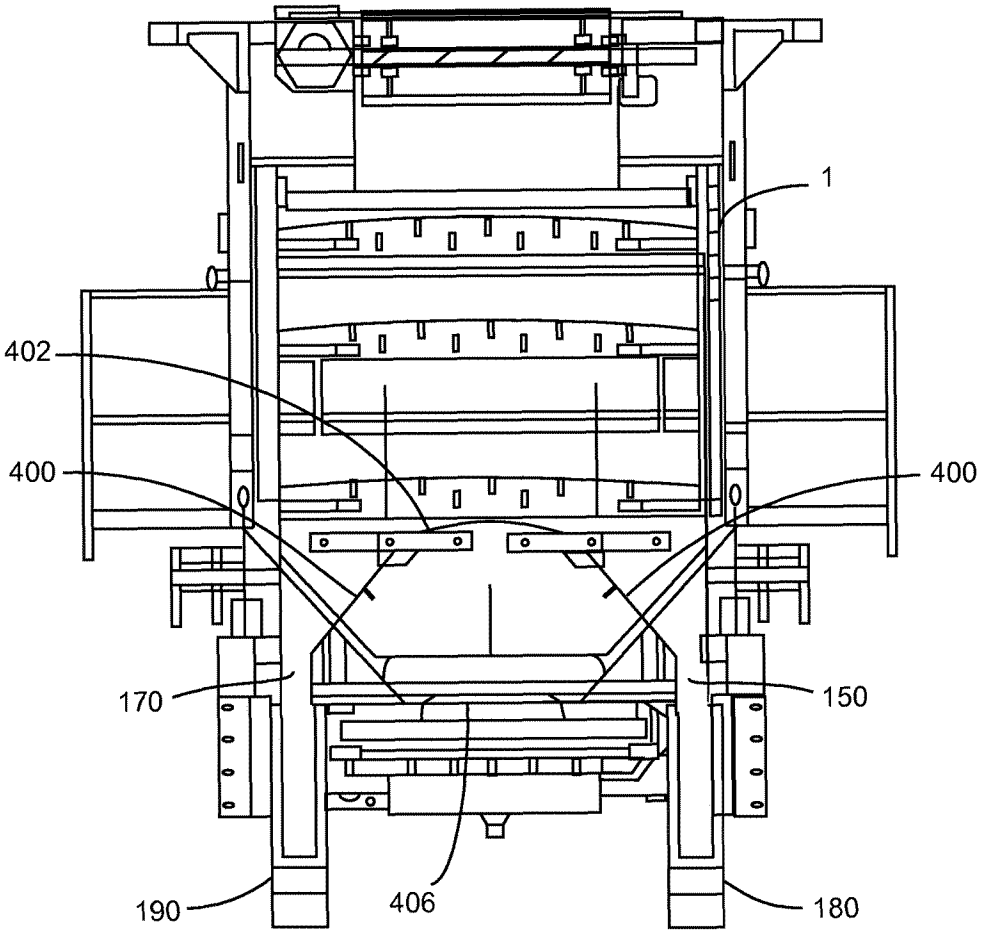
FIG. 17 is an end view of the screen of FIG. 1.

Now referring to FIG. 17, there is shown an end view of the screen 1 with an innovative fines scalping feature of the present invention. The system functions as follows: fines drop below the bottom screen deck onto underscreen fines pan 402, which carries the fines material to an area where they can be deflected into right-hand fines primary movable chute 150 and left-hand fines primary movable chute 170 or alternately passed down to underscreen discharge reject conveyor 406. Right-hand fines primary movable chute 150 and left-hand fines primary movable chute 170 are connected to the screen and are tilted up and down as the screen 1 is moved between various angular operating, transport and/or maintenance positions. Right-hand fines primary movable chute 150 mates with right-hand fines secondary fixed chute 180, which is fixed to the frame of the system (which does not pivot). Similarly, left-hand fines primary movable chute 170 mates with left-hand fines secondary fixed chute 190.

Figure 18:
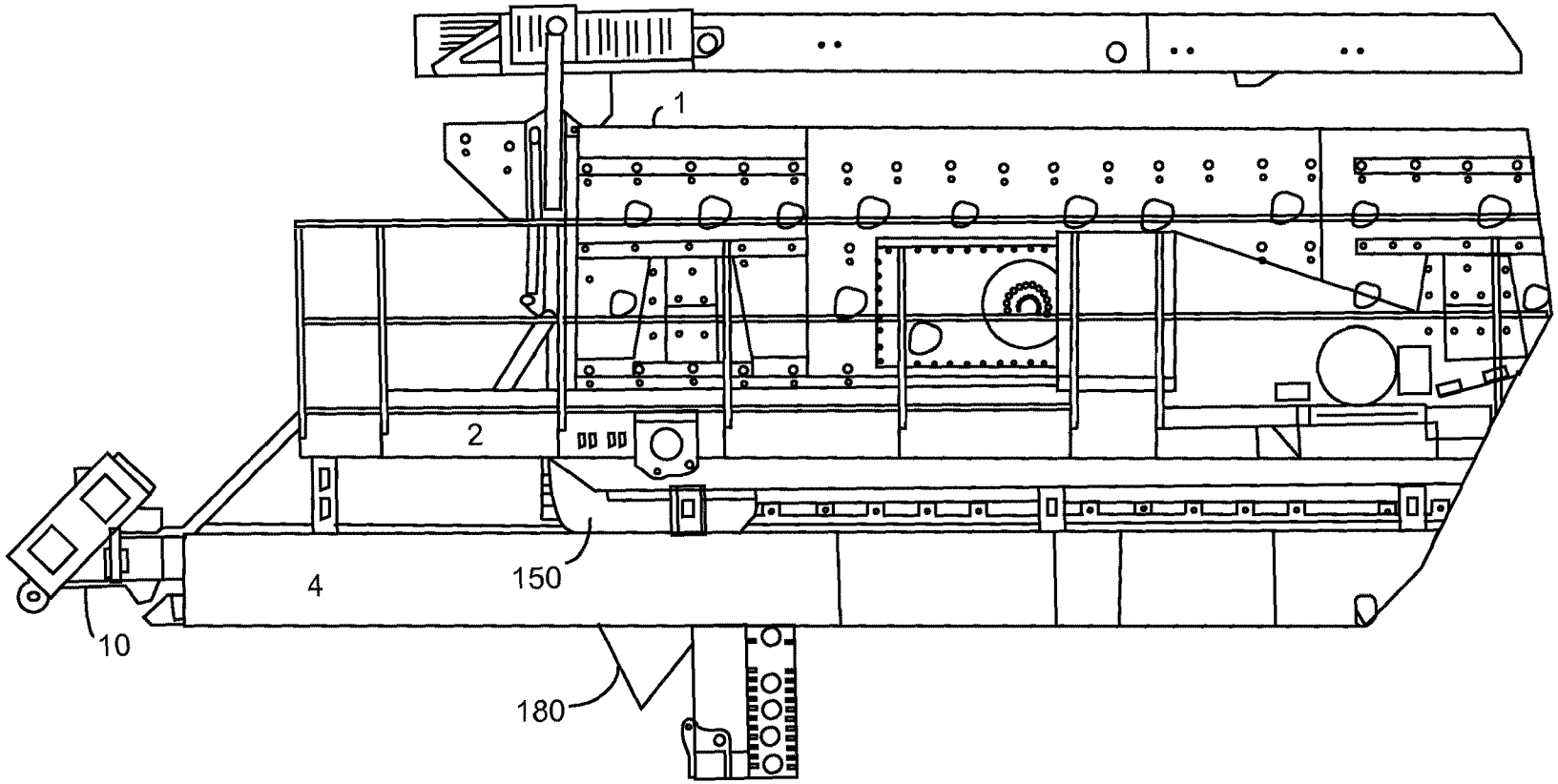
FIG. 18 is a close-up view of portions of the screen of FIG. 1.

Now referring to FIG. 18, there is shown a side view of the screen 1 in a horizontal (non-angled) position. The chutes are visible.

Figure 19:
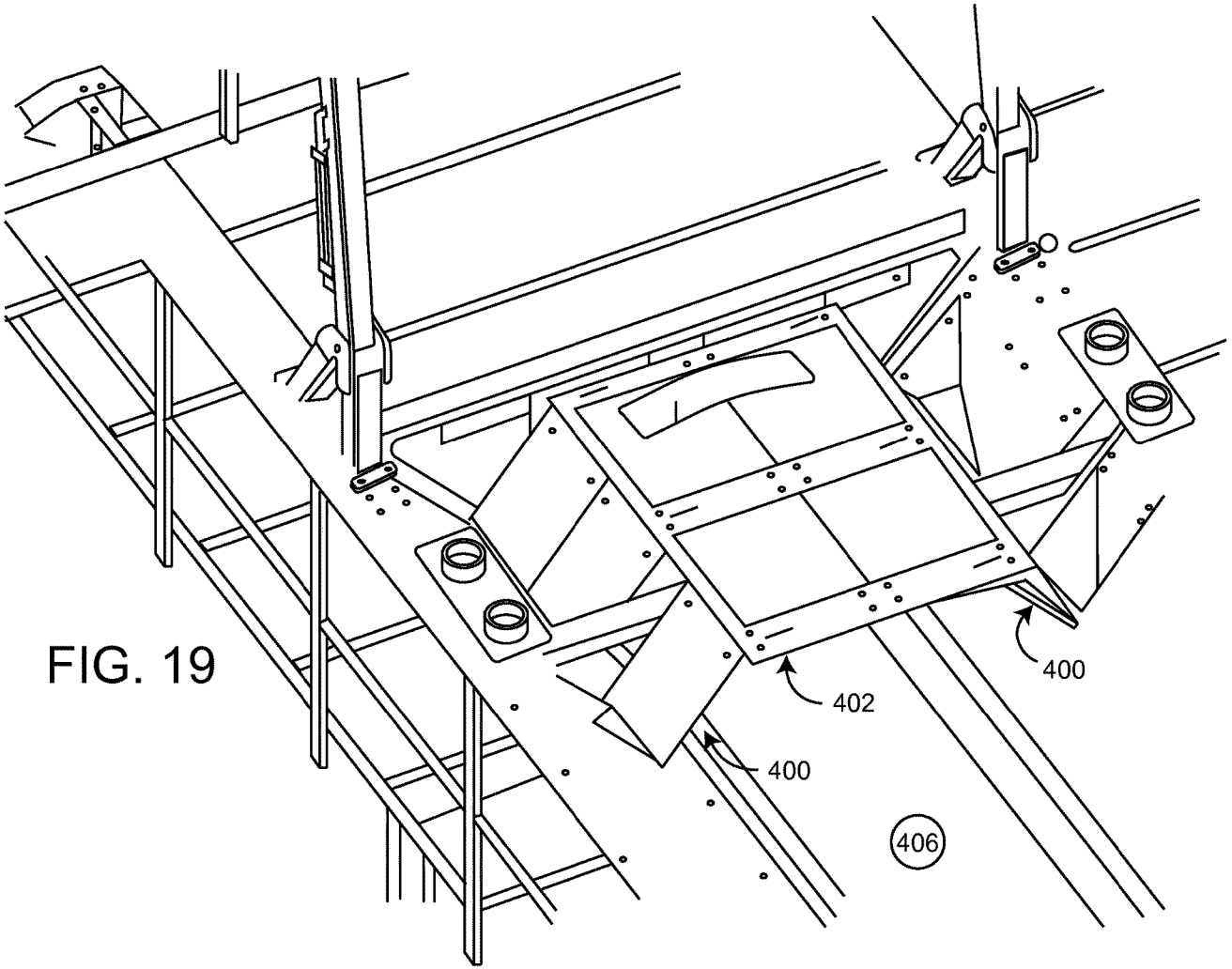
FIG. 19 is a close-up partially dismantled view exposing portions of the gates of the screen of FIG. 1.

Now referring to FIG. 19, there is shown a partially dismantled screen of the present invention which exposes to view the underscreen fines pan 402, adjustable deflecting gates 400 and underscreen discharge reject conveyor 406 and their respective orientations.

Figure 20:
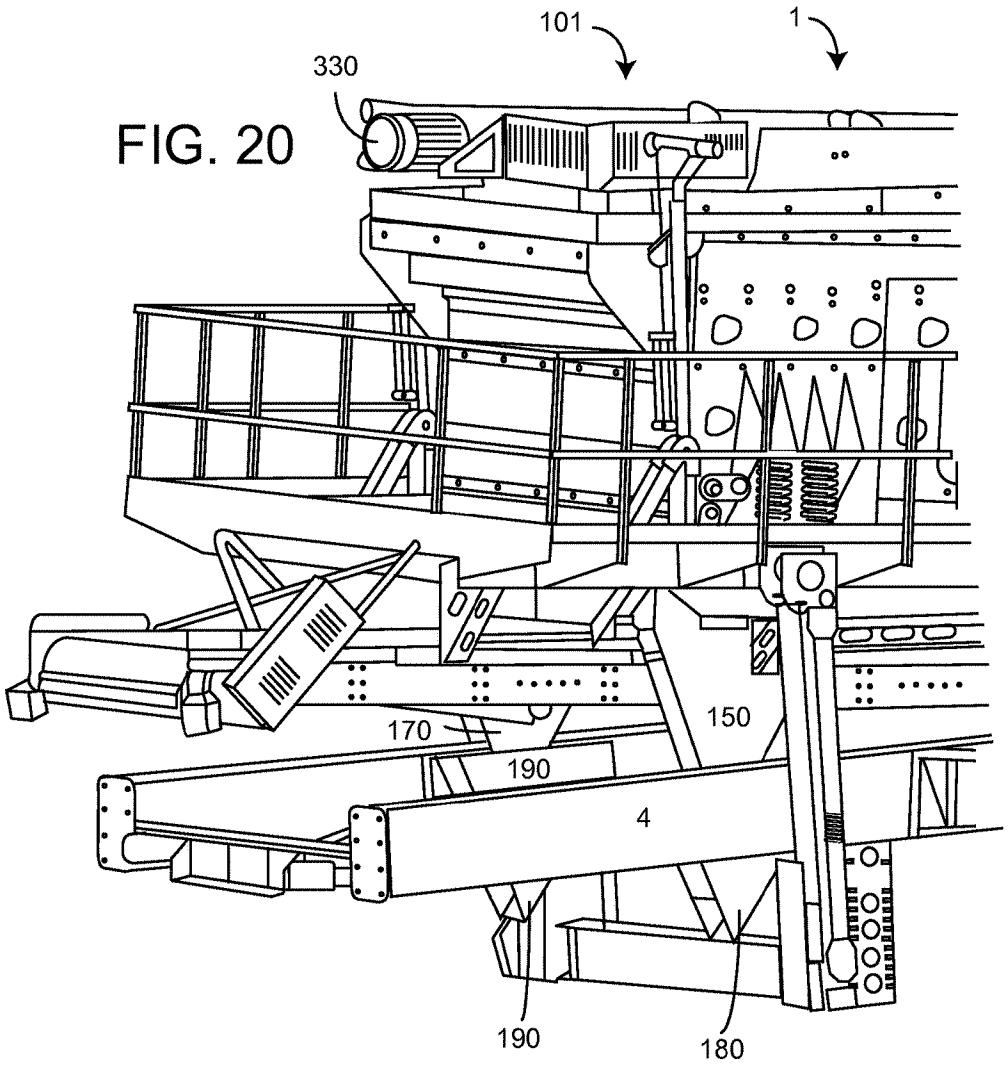
FIG. 20 is a close-up view of a portion of the chutes of the screen of FIG. 1.

Now referring to FIG. 20, there is shown a perspective view of the system of the present invention where nesting relationship of left-hand fines primary movable chute 170 and left-hand fines secondary fixed chute 190 is clearly shown.

Figure 21:
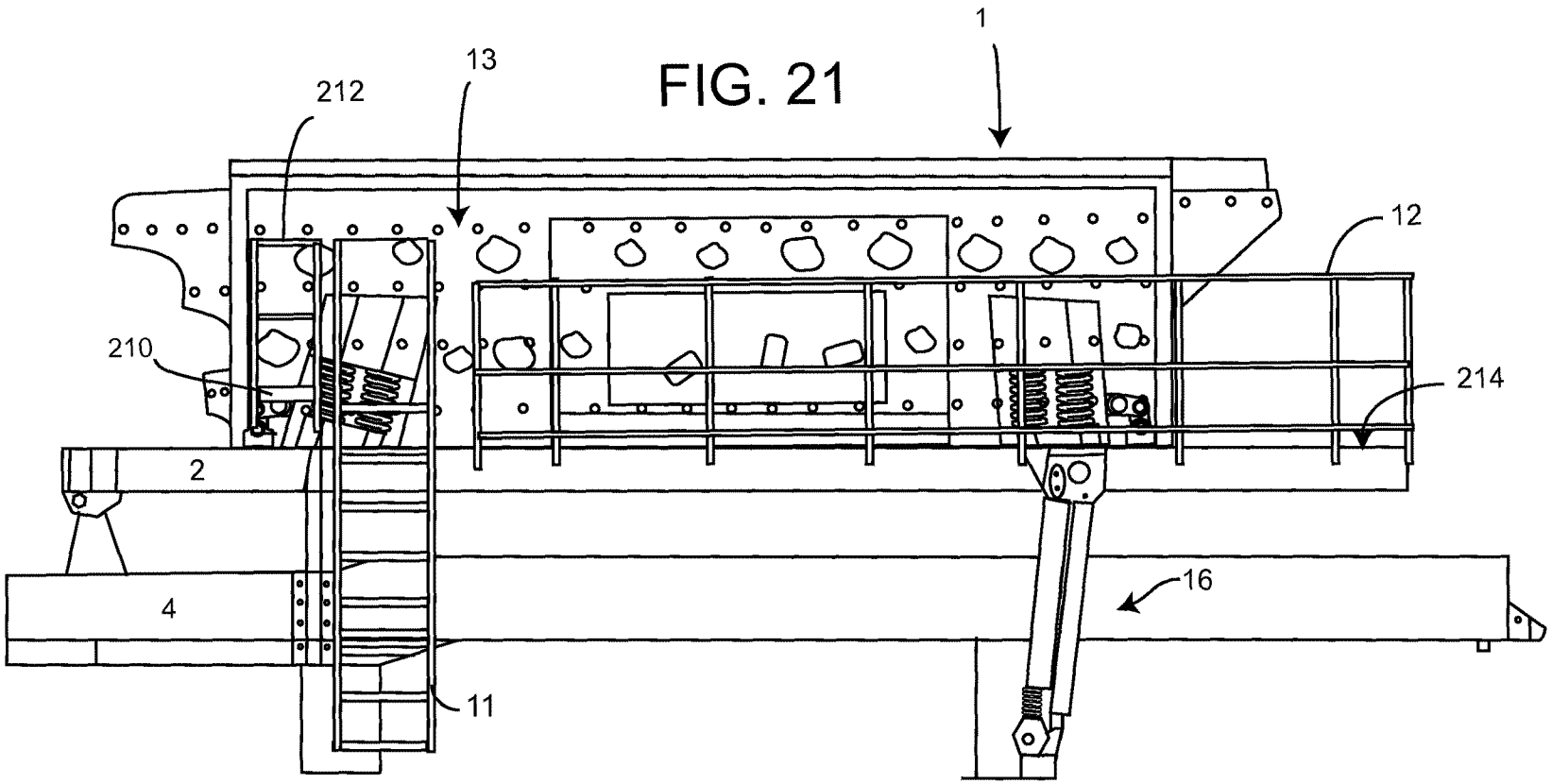
FIG. 21 is a side view of the screen of the present invention.
Figure 22:
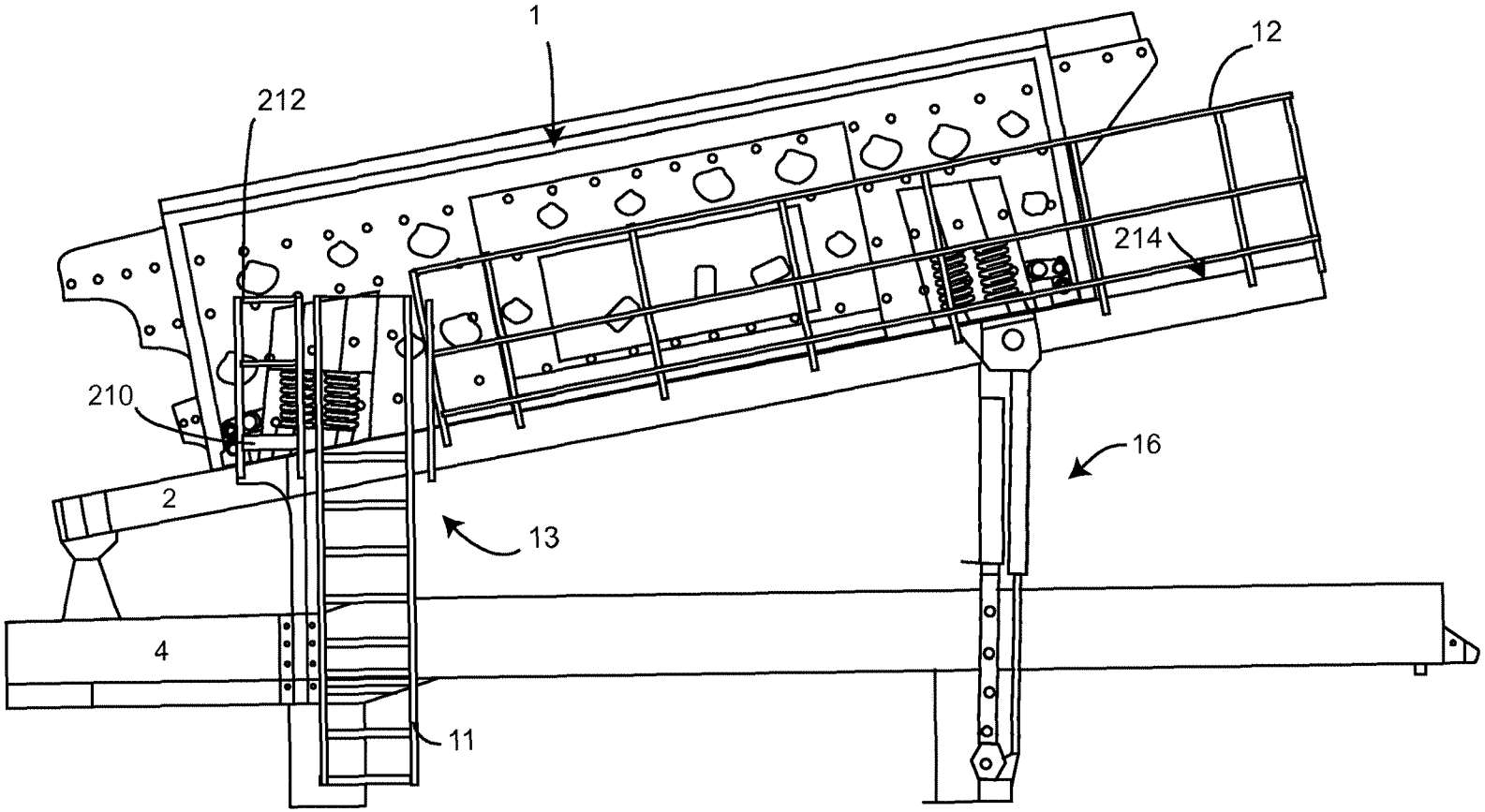
FIG. 22 is a side view of the screen of FIG. 21, but in sloped screen configuration.

Now referring to FIG. 21, there is shown a side view of the screen 1 of the present invention in a horizontal configuration, the gap 13 between stationary access platform railing 212 and railing 12 is shown at a maximum. Note that the stationary access platform railing 212 is fixed to the wheeled chassis main frame 4 as is the ladder 11. As the screen 1 pivots to various operating angles, the stationary access platform railing 212 and ladder 11 remain stationary; i.e., fixed to the frame 4. When the screen is in a horizontal configuration, the stationary access platform railing 212 and the pivoting access platform 214 may be flush; i.e., no step up required. When the screen is pivoted upwardly as is shown in FIG. 22, the stationary access platform railing 212 is stationary, and the nearest portion of the pivoting access platform 214 has been relatively elevated, thereby requiring a person to step up from the stationary access platform 210 to the pivoting access platform 214. However, as they walk along pivoting access platform 214, the railing 12 is at a constant height. In another configuration, there may be a required step down when the screen is in a horizontal configuration; and at a midpoint between horizontal and maximum inclination, no step up or down would be required and when the screen is at a maximum inclination, there would be a required step up. This level at the middle angle of inclination approach minimizes the magnitude of the highest step up or down required over the range of inclination angles. This configuration is shown in FIGS. 22 and 23.

Figure 23:
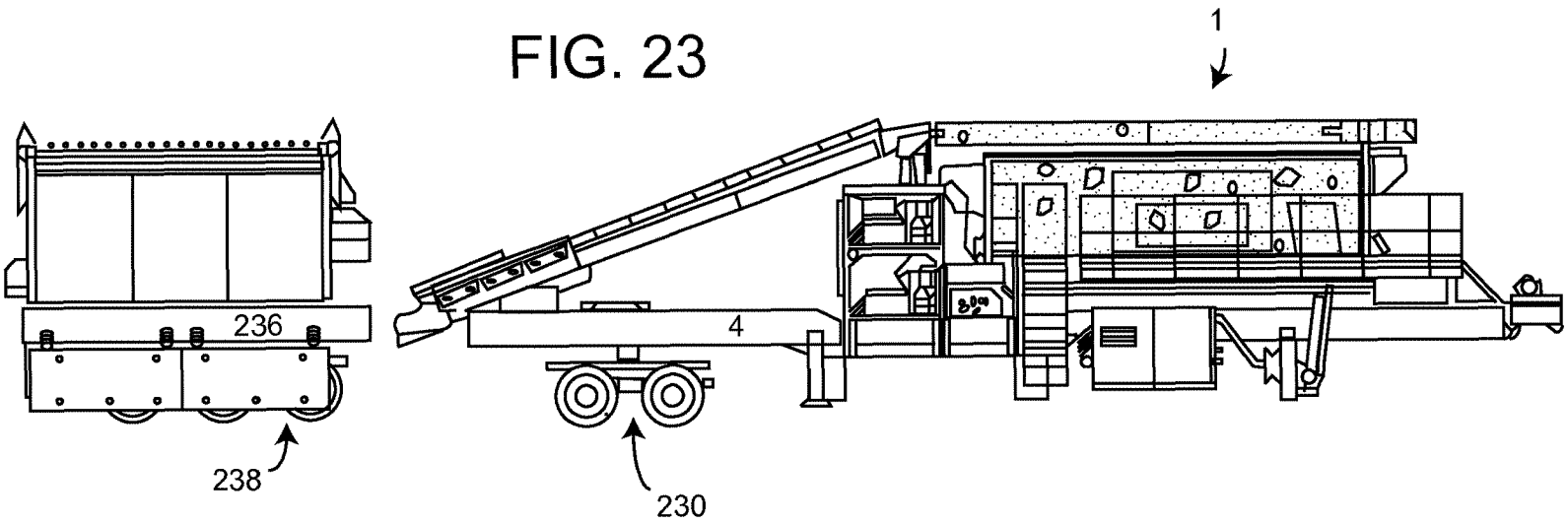
FIG. 23 is a view of the present invention in a detached modular configuration.

Now referring to FIG. 23, there is shown an alternate configuration of the system of FIGS. 1 and 2, where the wheels 238 are attached to a feed hopper frame 236 which is detached from the wheeled chassis main frame 4, which is now shown with wheels 230 attached thereto. This approach can permit use of the system without the feed hopper 5, or it can permit separate towing of the feed hopper 5 from the remainder of the system.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A mobile variable slope vibrating screen system for material processing comprising:

a vibrating screen, configured to operate in a substantially horizontal orientation;

a mobile chassis configured to support and transport said vibrating screen; and means for changing an angle of inclination of the vibrating screen so that said vibration screen can operate at angles from substantially 0 degrees to higher angles of inclination, with respect to said mobile chassis;

wherein said means for changing includes:

a base frame providing support to said vibrating screen and angularly adjustably connected to said mobile chassis;

a hydraulic cylinder;

an outer adjustable support leg;

an inner adjustable support leg;

a locking pin; and a hydraulic circuit configured to apply a biasing force to reduce slack.

2. The screen of claim 1 wherein said hydraulic circuit further comprises:

a Hydraulic pressure power unit which includes a hydraulic pump and a tank for providing high pressure hydraulic fluid to the hydraulic cylinder;

the Hydraulic pump is coupled to a system control valve, with three positions including:

a system control valve return to tank normal position, a system control valve return crisscross flow position; and a system control valve return up down position, depending on the direction the system control valve is slid;

a line a and a line b, each of which, exits the system control valve and goes to the hydraulic cylinder;

which has a port for applying pressure to retract and another for extending;

wherein each of the lines into each of these ports are capable of providing fluid into and receiving fluid from the cylinder;

Lines A and B enter a manifold and encounter a manifold pilot operated check valve which allows free-flow of oil into the cylinder; and a flow control valve meters oil out of the cylinder.

3. The screen of claim 2 wherein:

said aggregate material processing unit is one of a bolt-on feeder module and an integral rock crusher.

4. The screen of claim 2 wherein said aggregate material processing unit comprises one of a belt feeder, a vibratory feeder and a wobble feeder.

5. The screen of claim 1 wherein said hydraulic circuit actually applies a biasing force to reduce slack.

6. The screen of claim 5 wherein said mobile chassis comprises one of wheels and tracks.

7. The screen of claim 5 wherein said means for blending comprises a blend chute.

8. The screen of claim 7 wherein said vibrating screen further comprises a plurality of centrally located cross conveyors and an underscreen conveyor.

9. The screen of claim 2 wherein said aggregate material processing unit comprises a belt feeder with a variable frequency drive, configured to provide a constant feed of material to said overhead feed conveyor.

10. A variable slope vibrating screen system for material processing comprising:

a vibrating screen, configured to process aggregate material and operate at a plurality of operating angles of inclination;

a base configured to support said vibrating screen;

said plurality of operating angles of inclination of the vibrating screen comprises operating angles from substantially 0 degrees to higher angles of inclination, with respect to said base;

a hydraulic cylinder;

an outer adjustable support leg;

an inner adjustable support leg;

a locking pin; and a hydraulic circuit applying a biasing force to reduce slack.

11. The screen system of claim 10 wherein said plurality of operating angles of inclination extends incrementally upward from a substantially horizontal orientation.

12. The screen system of claim 11 wherein said vibrating screen can be changed from a horizontal configuration to a higher angle of inclination without the use of hand tools and without a need to dismantle any portion of said variable slope vibrating screen system.

13. The method of processing aggregate material comprising the steps of:

providing a vibrating screen configured to process aggregate material and operate at a plurality of operating angles of inclination;

providing a base configured to support said vibrating screen;

providing a hydraulic cylinder;

providing an outer adjustable support leg;

providing an inner adjustable support leg;

providing a locking pin;

providing a hydraulic circuit configured to apply a biasing force to reduce slack;

using said hydraulic circuit to apply a biasing force to reduce slack.

14. The method of claim 13 further comprising the steps of:

transporting said vibrating screen over a public roadway.

* * * * *